US006129342A

United States Patent [19]

Bronstad

[11] Patent Number: 6,129,342

[45] **Date of Patent: *Oct. 10, 2000**

[54] GUARDRAIL END TERMINAL FOR SIDE OR FRONT IMPACT AND METHOD

[75] Inventor: Maurice E. Bronstad, San Antonio, Tex.

[73] Assignee: TRN Business Trust, Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,616

[22] Filed: Jul. 11, 1997

[51] Int. Cl.[7] ..... E01F 13/00

[52] U.S. Cl. ..... 256/13.1; 404/6

[58] Field of Search ..... 256/13.1, 1; 404/6, 404/9, 10, 7

[56] References Cited

U.S. PATENT DOCUMENTS

| | | | |
|---|---|---|---|
| Re. 29,544 | 2/1978 | Fitch | 256/13.1 |
| D. 243,323 | 2/1977 | Waldsmith | D12/169 |
| 2,536,760 | 1/1951 | Martin et al. | 256/13.1 |
| 3,602,151 | 8/1971 | Walker | 104/256 |
| 3,672,657 | 6/1972 | Young et al. | 267/116 |
| 3,674,115 | 7/1972 | Young et al. | 188/1 B |
| 3,680,662 | 8/1972 | Walker et al. | 188/1 B |
| 3,695,583 | 10/1972 | Walker et al. | 256/1 |
| 3,779,591 | 12/1973 | Rands | 293/89 |
| 3,944,187 | 3/1976 | Walker | 256/13.1 |
| 3,973,596 | 8/1976 | Walker | 138/174 |
| 3,982,734 | 9/1976 | Walker | 256/13.1 |
| 4,008,915 | 2/1977 | Walker | 293/60 |
| 4,071,599 | 1/1978 | Walker | 264/311 |
| 4,072,334 | 2/1978 | Seegmiller et al. | 293/71 R |
| 4,073,482 | 2/1978 | Seegmiller et al. | 167/129 |
| 4,097,572 | 6/1978 | Walker | 264/310 |

(List continued on next page.)

FOREIGN PATENT DOCUMENTS

| | | |
|---|---|---|
| 0738802 | 3/1996 | European Pat. Off. . |
| 1296662 | 6/1969 | Germany . |
| 3809470 | 10/1989 | Germany . |

OTHER PUBLICATIONS

Copending patent application USSN 08/891,678 filed Jul. 11, 1997 entitled *Energy–Absorbing Guardrail End Terminal and method* by Maurice E. Bronsta, Jul. 1997.

PCT Search Report for PCT/US/14367 (091078.0733), Mar. 11, 1998.

PCT Search Report for PCT/US/14491 (091078.0734), Mar. 11, 1998.

America's Most Affordable Crash Cushion Terminal—CAT, Form 039302 Ahead of Its Time . . . Again, one page brochure, Syro, Inc.

MPS–350 III (TMA Per NCHRP Report—Level 3), one page brochure, Syro, Inc., Feb. 1997.

Adiem 350 . . . Now Certified to NCHRP Report 350, Level 3, one page brochure, Syro, Inc., Mar. 1997.

*Primary Examiner*—Lynne H. Browne
*Assistant Examiner*—David E. Bochna
*Attorney, Agent, or Firm*—Baker Botts L.L.P.

[57] ABSTRACT

An improvement to an energy-absorbing guardrail terminal for use on longitudinally extending roadways. The improved end terminal has a system for transferring forces from a floor structure of a vehicle to beams on the energy-absorbing guardrail end terminal during a side impact with the vehicle. The system for transferring forces includes a spacer channel attached between first and second guardrails and a force transfer member coupled to the spacer channel and having a portion extending to a position above ground level to receive a floor structure of a vehicle during a forceful side impact. A method of manufacturing a system for transferring forces from a floor structure of a vehicle to a guardrail end terminal during a forceful side impact includes attaching a force transfer member that extends to a position to engage the floor structure.

13 Claims, 5 Drawing Sheets

U.S. PATENT DOCUMENTS

| | | | |
|---|---|---|---|
| 4,274,665 | 6/1981 | Marsh, Jr. | 285/177 |
| 4,289,419 | 9/1981 | Young et al. | 404/6 |
| 4,330,106 | 5/1982 | Chisholm | 256/13.1 |
| 4,352,484 | 10/1982 | Gertz et al. | 256/13.1 |
| 4,452,431 | 6/1984 | Stephens et al. | 256/13.1 |
| 4,498,803 | 2/1985 | Quittner | 404/6 |
| 4,500,225 | 2/1985 | Quittner | 404/6 |
| 4,557,466 | 12/1985 | Zucker | 256/13.1 |
| 4,624,601 | 11/1986 | Quittner | 404/12 |
| 4,635,981 | 1/1987 | Friton | 293/1 |
| 4,655,434 | 4/1987 | Bronstad | 256/13.1 |
| 4,666,130 | 5/1987 | Denman et al. | 256/13.1 |
| 4,674,911 | 6/1987 | Gertz | 404/6 |
| 4,681,302 | 7/1987 | Thompson | 256/13.1 |
| 4,688,766 | 8/1987 | Zucker | 256/13.1 |
| 4,711,481 | 12/1987 | Krage et al. | 293/133 |
| 4,784,515 | 11/1988 | Krage et al. | 404/6 |
| 4,838,523 | 6/1989 | Humble et al. | 256/13.1 |
| 4,844,213 | 7/1989 | Travis | 188/377 |
| 4,934,661 | 6/1990 | Denman et al. | 256/13.1 |
| 5,009,542 | 4/1991 | Hardin, Jr. et al. | 404/6 |
| 5,022,782 | 6/1991 | Gertz et al. | 400/6 |
| 5,078,366 | 1/1992 | Sicking et al. | 256/13.1 |
| 5,088,874 | 2/1992 | Quittner | 416/460 |
| 5,112,028 | 5/1992 | Laturner | 256/13.1 |
| 5,192,157 | 3/1993 | Laturner | 404/6 |
| 5,199,755 | 4/1993 | Gertz | 293/120 |
| 5,211,503 | 5/1993 | Quittner | 404/6 |
| 5,230,582 | 7/1993 | Schmitt et al. | 404/6 |
| 5,248,129 | 9/1993 | Gertz | 256/13.1 |
| 5,286,137 | 2/1994 | Cicinnati et al. | 404/6 |
| 5,314,261 | 5/1994 | Stephens | 404/6 |
| 5,462,258 | 10/1995 | Gaillard et al. | 256/13.1 |
| 5,660,496 | 8/1997 | Muller et al. | 256/13.1 |

GUARDRAIL END TERMINAL FOR SIDE OR FRONT IMPACT AND METHOD

BACKGROUND OF THE INVENTION

Guardrails are traffic barriers placed along roadsides to screen errant vehicles from hazards behind the barrier. A common guardrail in the United States is constructed using a standard steel W-beam mounted on spaced wood or steel posts. Because the W-beam functions primarily in tension when redirecting impacting vehicles, a function of the end is to provide necessary anchorage for the beam to develop necessary tensile forces. In addition, since the guardrail end represents a discontinuity in the barrier system, it is subject to being struck "head-on" by vehicles with small departure angles from the roadway. When struck in this manner, the end might spear the vehicle. Some widely used terminal designs "bury" the W-beam at the end to eliminate spearing, but this design may have shortcomings including causing problems relating to vaulting and rollover due to the vehicle riding up the end, and subsequently becoming airborne.

Another type of highway safety device is the crash cushion device. Highway agencies have been using crash cushion devices at high accident locations for a number of years. These devices absorb the energy of head-on impacts with decelerations that are not life-threatening for design conditions. Crash cushioning devices typically involve a relatively large capital investment for roadside devices. Because the number of guardrail terminals is quite large, and the impact probability low for most, the states do not have the resources to employ crash cushion devices at most guardrail ends because of their expense.

Guardrail end terminals have been developed to help absorb energy during a head-on collision by a vehicle. For example, U.S. Pat. No. 4,655,434 to Bronstad discloses such an end terminal. This type of end terminal is designed to interact with a front portion of a vehicle.

Most vehicles on highways today are fairly well configured for a head-on impact with an end terminal. The bumper, engine, and engine compartment generally provide adequate structure for the end terminal to provide an energy absorbing force without unduly impinging on the passenger compartment. The same cannot generally be said for most side impacts.

Many vehicles on the highways today have minimal structure on the sides of the vehicle that may be used to receive an energy absorbing force from an end terminal without unduly impinging on the passenger compartment. The vehicle floor structure provides the most substantial resistance during side impacts.

SUMMARY OF THE INVENTION

According to an aspect of the present invention, a guardrail end terminal for side or front impacts is provided that addresses many shortcomings of previous end terminals. According to one aspect of the present invention, a system for transferring forces from a floor structure of a vehicle to beams on an energy-absorbing guardrail end terminal during a forceful side impact with the vehicle has a spacer channel attached between first and second beams and has a force transfer member coupled to the spacer channel that extends in part below the guardrails to a position above ground level to receive a floor structure of a vehicle during a forceful side impact.

According to another aspect of the present invention, a method of manufacturing a system for transferring forces from a floor structure of a vehicle to beams on an energy-absorbing guardrail end terminal during a side impact with the vehicle includes the steps attaching a spacer channel between first and second beams; forming a force transfer member; and attaching the force transfer member to the spacer channel with a portion of the force transfer member positioned above ground level to receive a floor structure of a vehicle during a forceful side impact.

BRIEF DESCRIPTION OF THE DRAWINGS

A more complete understanding of the invention and its advantages will be apparent from the detailed description taken in conjunction with the accompanying drawings in which.

DETAILED DESCRIPTION OF THE INVENTION

The preferred embodiments of the present invention and its advantages are best understood by referring to FIGS. 1–10 of the drawings, like numerals being used for like and corresponding parts of the various drawings.

The present invention includes an energy-absorbing guardrail end terminal that may include many features of known guardrails and guardrail end terminals. For example, the features of the guardrail end terminals shown in U.S. Pat. No. 4,655,434, entitled "Energy Absorbing Guardrail Terminal" and U.S. Pat. No. 4,838,523, entitled "Energy Absorbing Guard Rail Terminal" may be included. U.S. Pat. Nos. 4,655,434 and 4,838,523 are incorporated herein by reference for all purposes. While many of these features are discussed herein, it is to be understood that the present invention may be used as an aspect of many different types of end terminals as well.

Figure 1:
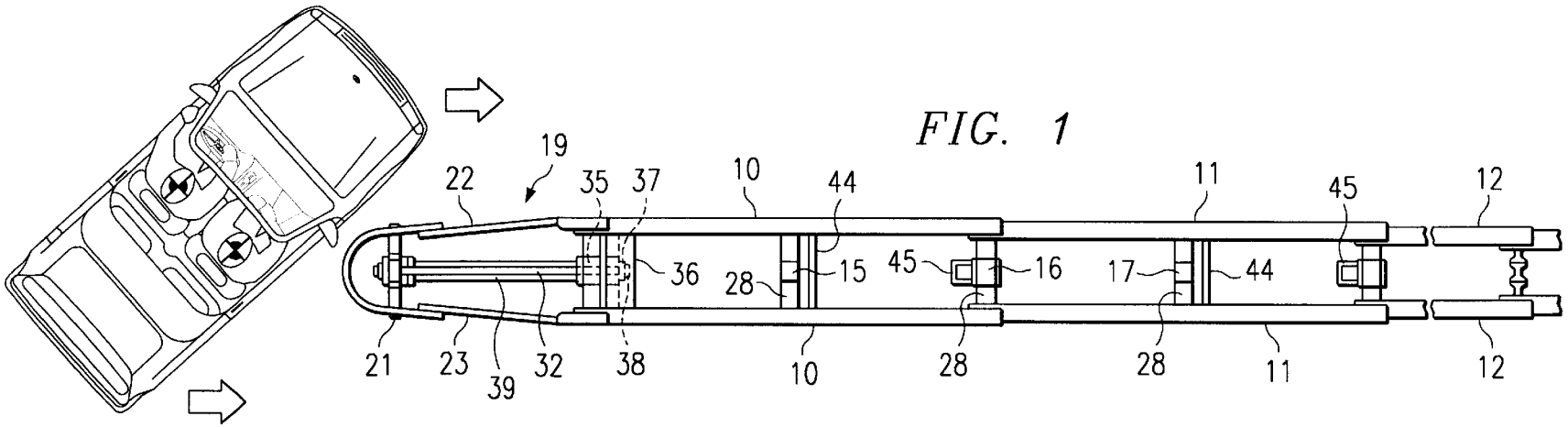
FIG. 1 is a plan view of an energy-absorbing guardrail end terminal according to an aspect of the present invention.
Figure 2:
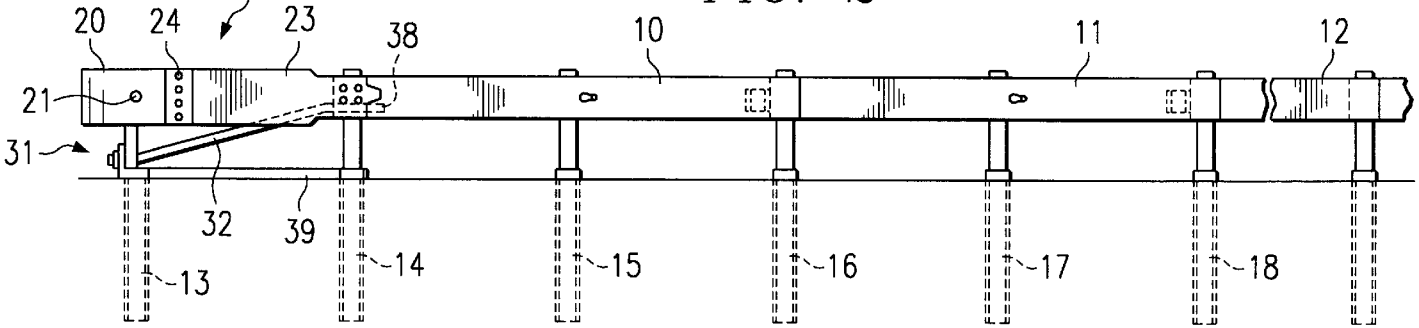
FIG. 2 is a side elevation view of the structure of FIG. 1.

Referring to FIGS. 1 and 2, an end terminal may include multiple pairs of oppositely disposed horizontally extending beams 10, 11 and 12 having overlapping ends supported from a plurality of longitudinally spaced vertical break-away wooden posts 13 through 18. The beam pairs may be of any suitable rigid material, but preferably are of a conventional metal W-beam rail configuration.

An impact nose section 19 is placed at the upstream, vehicle-approach end of the terminal. Nose section 19 includes a three-part wrap around construction with a curved end piece 20 secured to post 13 by a fastener 21. Oppositely disposed nose panels 22 and 23 overlap and are secured to the free ends of curved end piece 20 by a plurality of fasteners 24. The remaining ends of nose panels 22 and 23 are secured in overlapping relationship to the respective ends of beam pairs 10 and post 14.

Post 13 to which nose curved piece 20 is secured has a main body member, which is notched inwardly of its upstanding free end reducing the effective cross-sectional dimension of the post at the notch by approximately one-half. Wooden spacer blocks 28 may be secured to post 13 by fastener 21. Each of posts 13–18 is preferably positioned within a metal post tube with a soil anchor plate secured to the post and post tube below ground level.

Figure 3:
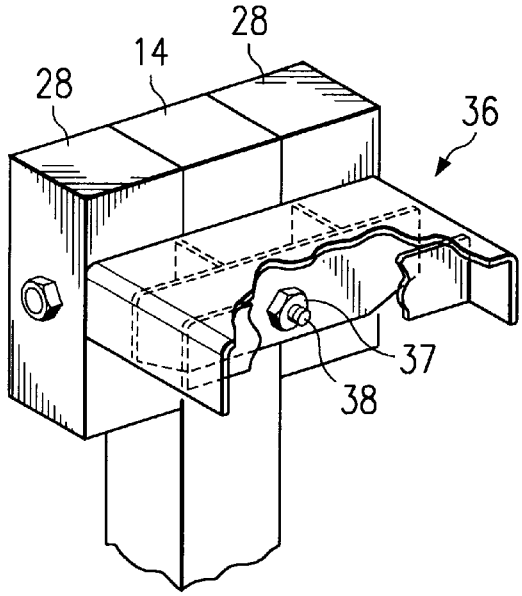
FIG. 3 is perspective view of an enlarged portion of the guardrail end terminal showing a spacer channel with portions broken away.

A cable assembly 31 has a steel cable 32 extending through an aperture in the notch portion of post 13 as best shown in FIG. 2. The other end of cable 32 extends through an aperture in post 14 at 35 and a spacer channel 36 that extends between beams 10 abutting post assembly 14 as seen in FIGS. 1, 2, and 3. A pair of nuts 37 are threadably secured to the end of a stud 38 swage connected to the end of cable 32 as is known in the art. A post connection strut 39 extends between posts 13 and 14 just above the terminal end of steel post tubes and just below cable 32 on post 13 only.

Cable assembly 31 helps define a load path during angular impacts down stream of the end terminal. Connection strut 39 interconnects the respective posts 13 and 14. Notch post 13 will break-away upon an end impact while the cable assembly anchored to post 13 will act as an anchor for cable 32 and its attached post 14 and spacer channel 36 which helps with downstream impacts on the guardrail.

The overlapping ends of beam pairs 10, 11, and 12 are preferably secured to one another via shearing bolts. Slot configurations illustrated in FIGS. 6 and 9 of the drawings provide energy-absorbing shredding of the metal strips between a series of openings or slots in the beams upon impact.

Referring again to FIG. 1 of the drawings, connecting rods 44 will be seen extending transversely between the respective beam pairs 10 and 11 adjacent posts 15 and 17. Each of rods 44 is fastened to the beam pairs via a keyhole opening in the beam. Downstream from each connecting rod 44 a box beam 45 is mounted on the upstream side of each posts 16 and 18 respectively. Each of the box beams engages, bends and releases rod 44 upon impact as beam pairs 10 and 11 telescope down over one another during a forceful impact. As used herein, "forceful impact" means an impact by a vehicle with sufficient momentum to at least cause posts 13 and 14 to break away and beams 10 to telescope at least in part.

Figure 4:
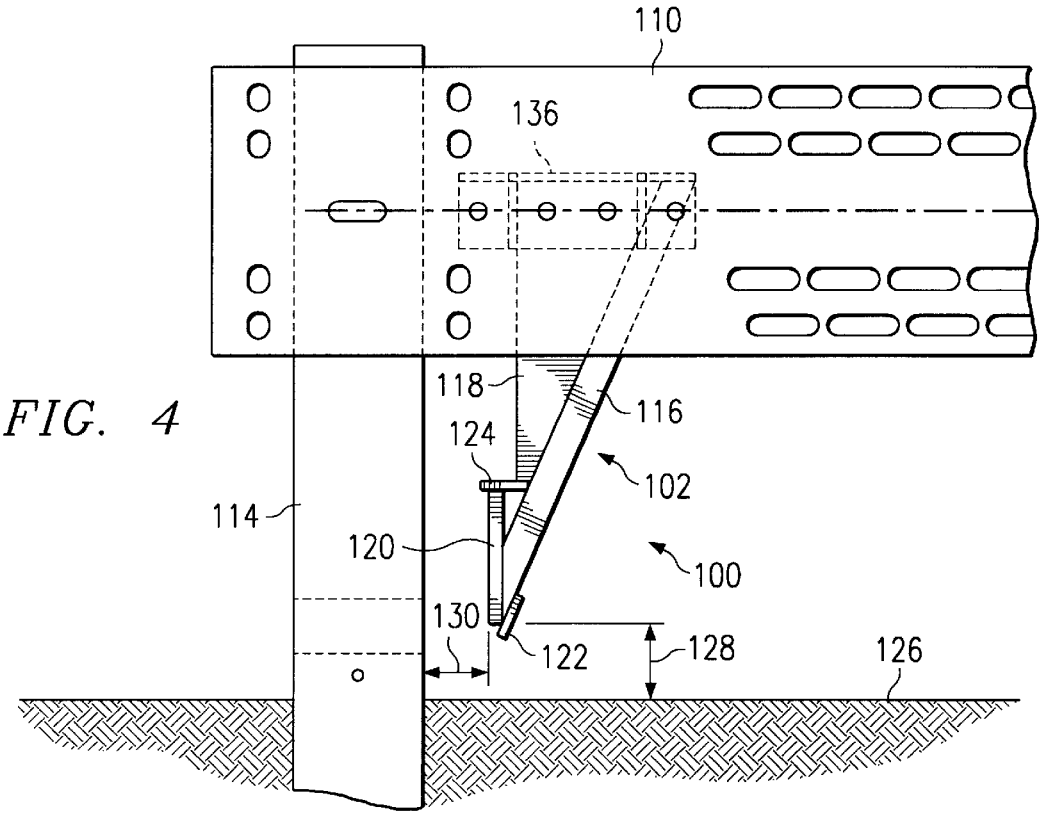
FIG. 4 is schematic elevation view of a system or mechanism according to an aspect of the present invention for transferring forces from a floor structure of a vehicle to an energy-absorbing guardrail end terminal.
Figure 5:
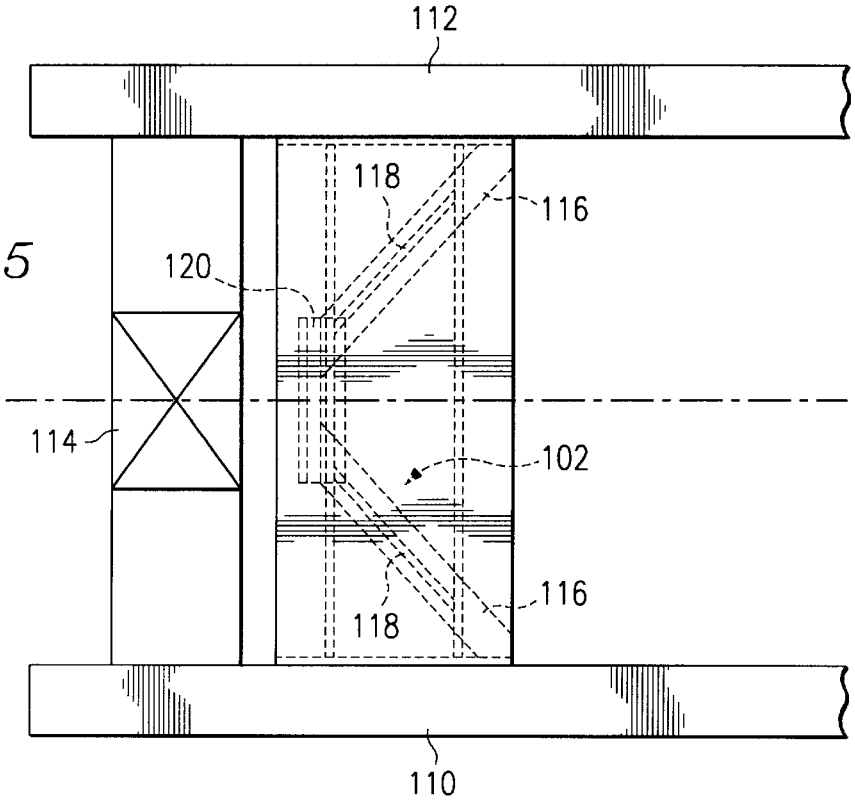
FIG. 5 is a schematic plan view of the system of FIG. 4.

An important aspect of the present invention is that structure is included to transfer forces from a vehicle's floor or floor structure during forceful impacts with a side of a vehicle as well as being able to accommodate head on impacts. Referring to FIGS. 4 and 5, a force transfer mechanism or system 100 for transferring forces from a side floor structure 7 of a vehicle 9 (FIG. 1) to a portion of the guardrail during a side impact (as suggested in FIG. 1) is presented.

As described more fully in connection with reference numeral 36 of FIGS. 1–3, a spacer channel 136 (FIGS. 4 and 5) is attached to beam 110 at one end and the other beam 112 on the other end of channel 136. Spacer channel 136 is preferably secured near a downstream portion of post 114. Spacer channel 136 may be bolted or welded about its ends to beams 110 and 112. Attached to a portion of spacer channel 136 is a force transfer member 102.

Force transfer member 102 may include support members 116 and one or more gusset plates, such as gusset plates 118. A reactor plate 120 may be attached to force transfer member 102. A deflector plate 122 may also be attached on a portion of support member 116. Support members 116 may be angled towards one another as shown in FIG. 5. Additional strengthening plates, such as plate 124, may be attached. The attachments of components noted herein may be by fasteners, welding, or by other techniques known in the art.

Reactor plate 120 and/or a lower portion of force transfer member 102 are positioned low enough to ground 126 to engage the floor panel or floor structure of most vehicles. System 100 is thus operable to engage the floor structure during a side impact and transfer forces to spacer channel 136 of the guardrail system.

For one embodiment, a bottom portion of reactor plate 120 and force transfer member 102 are preferably approximately 3" above ground 126 as indicated by dimension reference number 128. For this specific embodiment (shown in FIGS. 4 and 5), the reactor plate is shown approximately 3" behind post 114 as is indicated by dimension reference number 130. Reactor plate 120 is preferably positioned and sized to allow post 114 to break away during a forceful impact by vehicle and engage the floor structure if the impact is on a side portion of the car.

Figure 8:
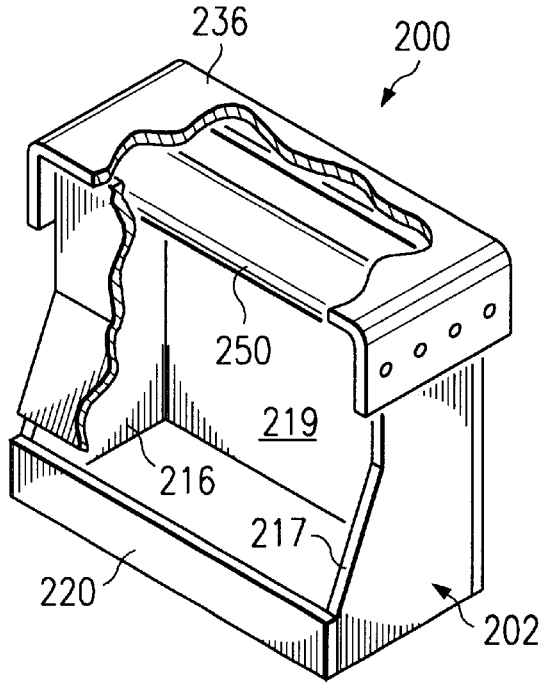
FIG. 8 is a partial perspective view of the system of FIGS. 6 and 7.
Figure 6:
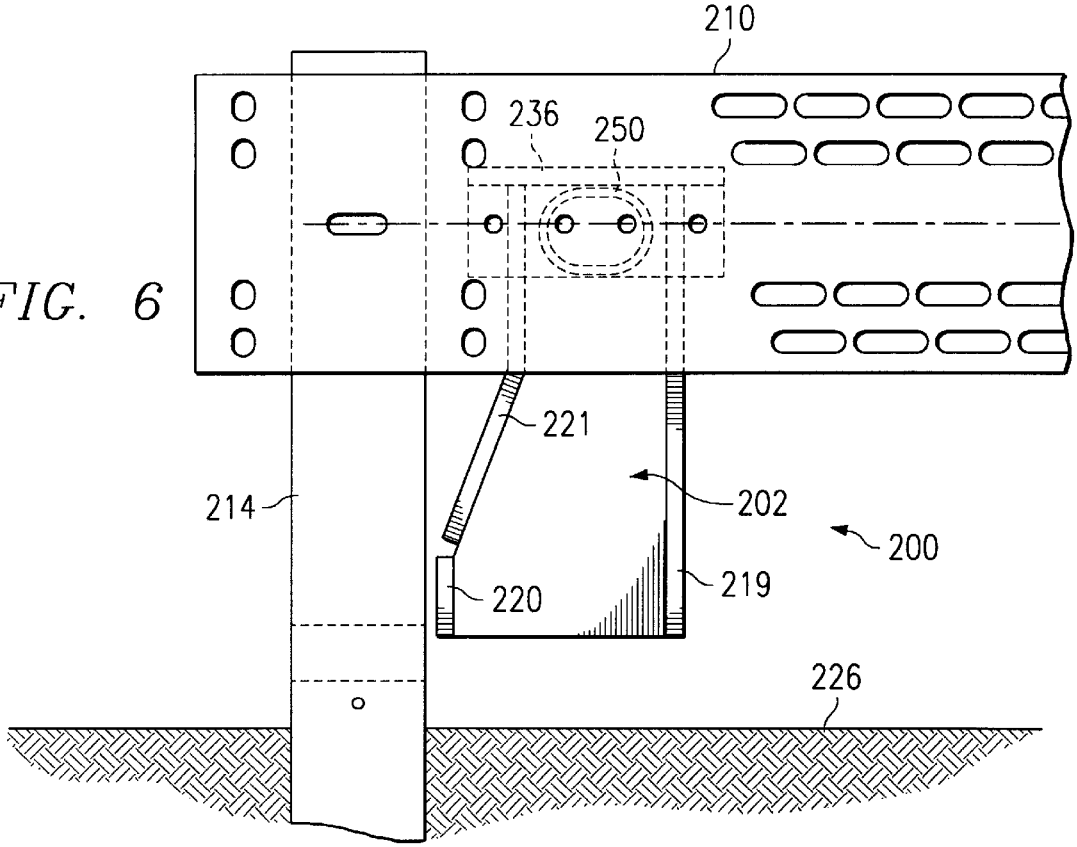
FIG. 6 is a schematic elevation view of another embodiment of a system or mechanism for transferring forces from a floor structure of a vehicle to an energy-absorbing guardrail end terminal according to an aspect of the present invention.
Figure 7:
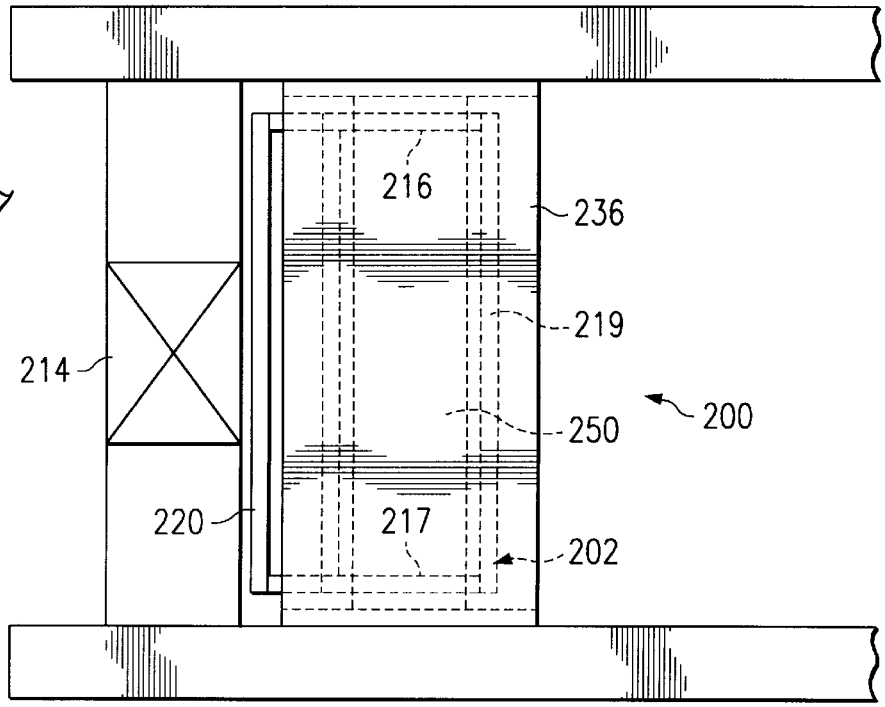
FIG. 7 is a schematic plan view of the system of FIG. 6.

According to aspects of the present invention, numerous designs may be utilized to engage the floor structure of a side impacting vehicle and transfer forces to beams 110 and 112. Another example of a system or mechanism 200 according to an aspect of the present invention is shown in FIGS. 6–8. In this embodiment, a torsion bar 250 is secured, preferably by welding, to internal surfaces of spacer channel 236. Spacer channel 236 is located adjacent to post 214. A force transfer member 202 has a first member 216 and a second member 217. Members 216 and 217 have a first and a second lateral edge (or end). On the second lateral edges, a third member 219 may be attached to members 216 and 217 for additional strength and stability. On a portion of the first lateral edges of members 216 and 217 of transfer member 202, a reactor plate 220 may be attached. An additional plate 221 may be attached on another portion of the first lateral edges of members 216 and 217 as shown if FIG. 6.

As with the previous embodiment, force transfer member 202 and/or reactor plate 220 are positioned to engage the floor structure of a vehicle having a forceful side impact with the guardrail end terminal. Additional plates and reinforcements may be added to force transferring mechanism or system 200. As with the previous embodiment, post 214 is designed to break away upon impact and force transfer member 202 will transfer forces from a side floor structure of a vehicle to an approximate centroid of the beams, e.g. beam 210.

Figure 9:
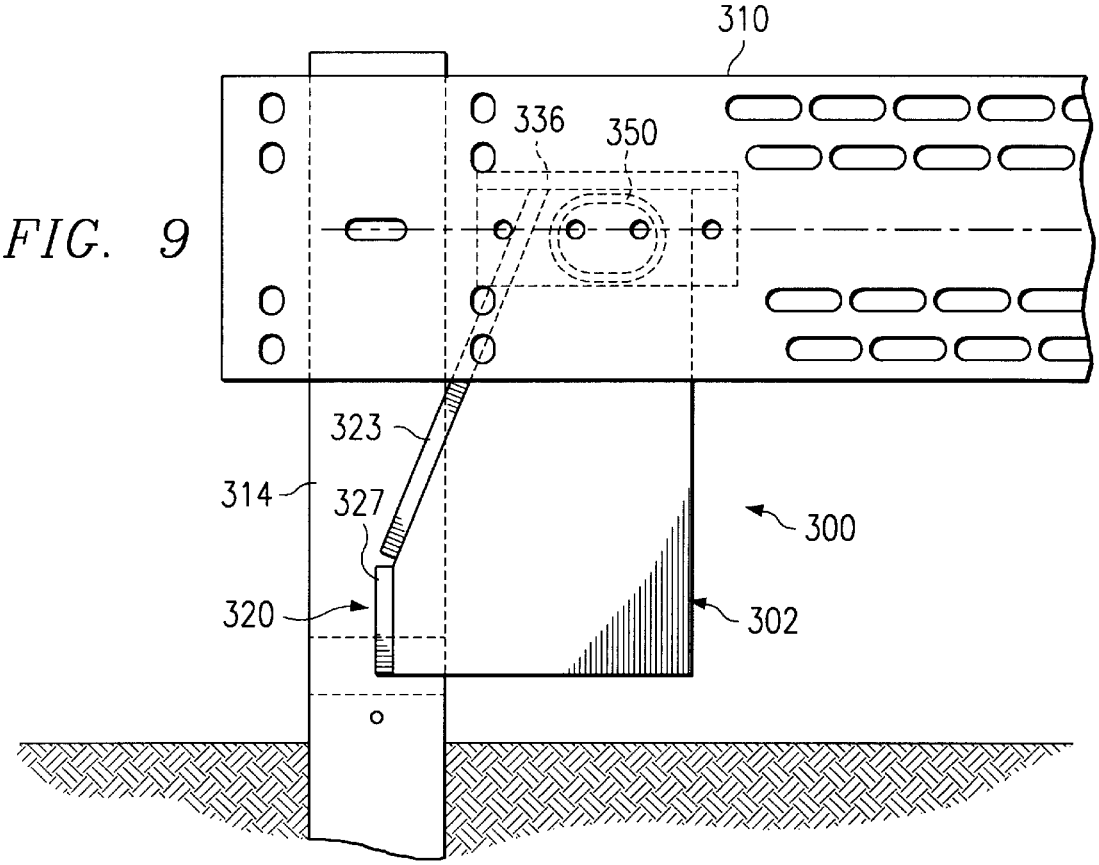
FIG. 9 is a schematic elevation view of another embodiment of a system or mechanism for transferring forces from a floor structure of a vehicle to an energy-absorbing guardrail end terminal according to an aspect of the present invention.
Figure 10:
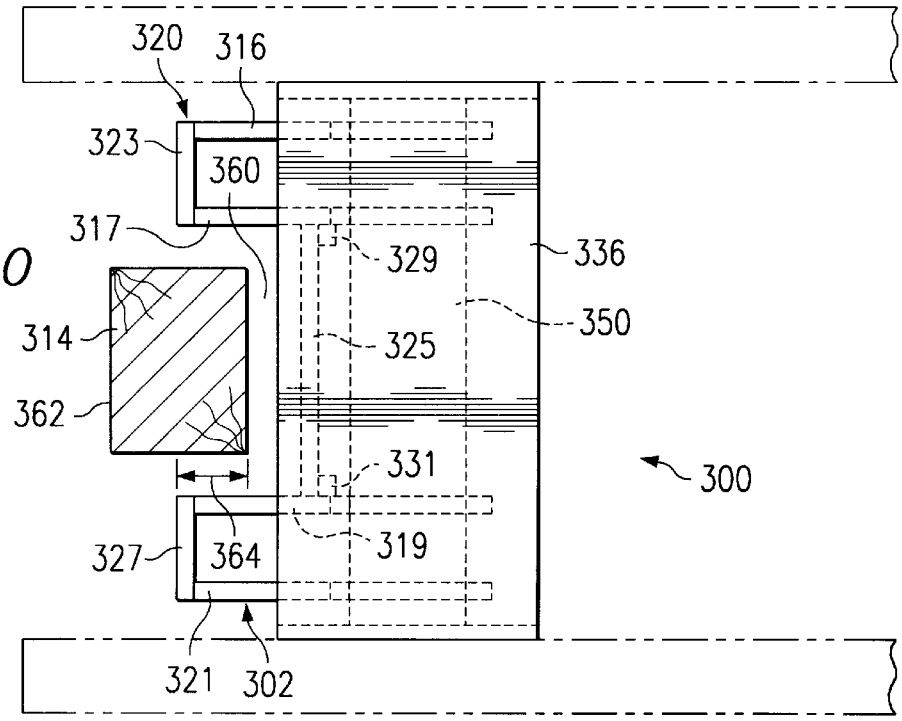
FIG. 10 is a schematic plan view of the system or mechanism of FIG. 9.

Referring now to FIGS. 9 and 10, another embodiment of a system for transferring forces is shown. Force transfer mechanism or system 300 is attached to spacer channel 336. A torsion bar 350 is attached, preferably by welding, to spacer channel 336. A force transfer member 302 transfers forces to spacer channel 336 during forceful side impacts. Force transfer member 302 has a first member 316, a second member 317, a third member 319, and a fourth member 321. Each member 316–321 may be welded to a portion of torsion bar 350 and/or spacer channel 336. As shown in FIG. 9, a number of additional support plates, such as plate 323, may be attached to the members.

With this embodiment, reaction plate 320 may have three distinct members 400, 325, and 327 as shown best in FIG. 10. Support members 316, 317, 319, and 321 have a first lateral edge and a second lateral edge. Attached to a portion of the first lateral edge of members 316 and 317 is first reaction plate member 400. Similarly, attached to the first lateral edge of members 319 and 321 is third reaction plate member 327. Middle or second reaction plate member 325 is attached to an intermediate surface portion of support members 317 and 319. Second reaction plate member 325 may further be reinforced in position by supports or blocks 329 and 331.

As with the previous embodiments, system 300 is designed to engage a portion of the floor structure of a vehicle during a forceful side impact with the end terminal and to transfer the forces from the floor structure to a portion of the guardrails, such as the centroid of beam 310. With the embodiment shown in FIGS. 9 and 10, reaction plate 320 is divided into distinct members 400, 325, and 327 which are sized and configured to allow post 314 to break away and be forced into channel 360 (FIG. 10) with a portion of post 314 resting against second reaction plate 325. As shown by dimension reference numeral 364, first and third plate members 400 and 327 are located upstream of a back side of post 314 by approximately 2 ¼" to 2 ½" or as necessary to allow post 314 to break and be received within cavity 360. With post 314 in channel 360, first reaction plate 400, a surface 362 of post 314, and third reaction plate number 327 present a substantially flush surface for bearing against the floor structure of the vehicle which is impacting from a side angle. Because combined surface areas 400, 362, and 327 are larger than other embodiments, the resultant force experienced by a portion of the floor structure engaged by system 300 is smaller than with other designs.

Although the present invention and its advantages have been described in detail, it should be understood that various changes, substitutions, and alterations can be made therein without departing from the spirit and scope of the invention as defined by the appended claims.

What is claimed is:

1. A system for transferring forces from a floor structure of a vehicle to an energy-absorbing guardrail end terminal during a side impact by the vehicle, the guardrail end terminal having a first beam and a second beam, the system for transferring forces comprising:

a spacer channel attached between the first and second beams;

a force transfer member having a first end and a second end, the first end coupled to the spacer channel and the second end extending below the first and second beams to a position above ground level to engage the floor structure of the vehicle during the side impact; and a reactor plate attached to the second end of the force transfer member, the reactor plate positioned 3" to 9" above ground level for receiving the floor structure of the vehicle during the side impact.

2. A system for transferring forces from a floor structure of a vehicle to an energy-absorbing guardrail end terminal during a side impact by the vehicle, the guardrail end terminal having a first beam and a second beam, the system for transferring forces comprising:

a spacer channel attached between the first and second beams;

a force transfer member having a first end and a second end, the first end coupled to the spacer channel and the second end extending below the first and second beams to a position above ground level to engage the floor structure of the vehicle during the side impact;

the force transfer member having a first and second support members, the first and second support members coupled at a first end to the spacer channel; and a reactor plate coupled to a portion of the first and second support members proximate a second end of the first and second support members.

3. A system for transferring forces from a floor structure of a vehicle to beams on an energy-absorbing guardrail end terminal during a side impact by the vehicle, the guardrail end terminal having a first beam and a second beam, the system for transferring forces comprising:

a spacer channel attached between the first and second beams;

a force transfer member having a first end and a second end, the first end coupled to the spacer channel and the second end extending below the first and second beams to a position above ground level to engage the floor structure of the vehicle during a side impact;

the force transfer member having a first support member and a second support member coupled at a first end to the spacer channel;

a reactor plate coupled to a portion of the first support member and the second support member proximate a second end of the first support member and the second support member;

a first gusset plate coupled to a portion of the spacer channel and a portion of the first support member; and a second gusset plate coupled to the spacer channel and a portion of the second support member.

4. A system for transferring forces from a floor structure of a vehicle to a first beam and a second beam of an energy absorbing guardrail end terminal during a side impact by the vehicle, comprising:

a spacer channel attached between the first beam and the second beam;

a force transfer member having a first end and a second end, the first end coupled to the spacer channel and the second end extending below the first beam and the second beam to a position above ground level to engage the floor structure of the vehicle during the side impact;

a torsion bar coupled to the spacer channel, and wherein the force transfer member comprises:

a first member having a first and second end and a first and second lateral edge, the first end of first member coupled to the spacer channel and the torsion bar;

a second member having a first and second end and a first and second lateral edge, the first end of the second member coupled to the spacer channel and torsion bar; and a reactor plate coupled on the first lateral edge of the first member and the first lateral edge of second member.

5. The system of claim 4 wherein the force transfer member further comprises a third member coupled to the second lateral edge of the first member and the second lateral edge of the second member.

6. A system for transferring forces from a floor structure of a vehicle to a first beam and a second beam of an energy absorbing guardrail end terminal during a side impact by the vehicle, comprising:

a spacer channel attached between the first beam and the second beam;

a force transfer member having a first end and a second end, the first end coupled to the spacer channel and the second end extending below the first beam and the second beam to a position above ground level to engage a floor structure of the vehicle during the side impact;

a first member having a first and second end and a first and second lateral edge, the first end of the first member coupled to the spacer channel;

a second member having a first and second end and a first and second lateral edge, the first end of the second member coupled to the spacer channel; and a reactor plate coupled on the first lateral edge of the first member and the first lateral edge of second member.

7. A system for transferring forces from a floor structure of a vehicle to a first beam and a second beam of an energy absorbing guardrail end terminal during a side impact by the vehicle, comprising:

a spacer channel attached between the first beam and the second beam;

a force transfer member having a first end and a second end, the first end coupled to the spacer channel and the second end extending below the first beam and the second beam to a position above ground level to engage a floor structure of the vehicle during the side impact;

a first plate member having a first and second end and a first and second lateral edge;

a second plate member having a first and second end and a first and second lateral edge;

a third plate member having a first and second end and a first and second lateral edge;

a fourth plate member having a first and second end and a first and second lateral edge;

the first end of the first, second, third, and fourth plate members attached to the spacer channel;

a first reactor plate member coupled to the first lateral edge of the first and second plate members;

a second reactor plate member coupled to an intermediate plate surface of the second and third plate members; and a third reactor plate member coupled to the first lateral edge of the third and fourth plate members.

8. The system of claim 7 wherein the second reactor plate and a portion of the second and third plate members form a post-receiving cavity.

9. A method of manufacturing a system for transferring forces from a floor structure of a vehicle to an energy-absorbing guardrail end terminal during a side impact with the vehicle, the guardrail end terminal having a first beam and a second beam, the method comprising the steps of:

attaching a spacer channel between the first and second beams;

forming a force transfer member;

attaching the force transfer member to the spacer channel with a portion of the force transfer member positioned above ground level to receive a floor structure of a vehicle during the side impact; and attaching a reactor plate to the second end of the force transfer member 3" to 9" above ground level for receiving the floor structure of the vehicle.

10. A method of manufacturing a system for transferring forces from a floor structure of a vehicle to an energy-absorbing guardrail end terminal during a side impact with the vehicle, the guardrail end terminal having a first beam and a second beam, the method comprising the steps of:

attaching a spacer channel between the first and second beams;

forming a force transfer member;

attaching the force transfer member to the spacer channel with a portion of the force transfer member positioned above ground level to receive a floor structure of a vehicle during the side impact;

forming a first and second support members as components of the force transfer member; and attaching a reactor plate to a portion of the first and second support members proximate a second end of the first and second support members.

11. A method of manufacturing a system for transferring forces from a floor structure of a vehicle to a first beam and a second beam of an energy-absorbing guardrail end terminal during a side impact with the vehicle comprising:

attaching a spacer channel between the first beam and the second beam;

forming a force transfer member;

attaching the force transfer member to the spacer channel with a portion of the force transfer member positioned above ground level to receive the floor structure of the vehicle during the side impact;

forming a first support member and a second support member;

coupling the first and second support members at a first end to the spacer channel;

attaching a reactor plate to a portion of the first support member and the second support member proximate to a second end of the first support member and the second support member;

attaching a first gusset plate to a portion of the spacer channel and a portion of the first support member; and attaching a second gusset plate to the spacer channel and a portion of the second support member.

12. A method of manufacturing a system for transferring forces from a floor structure of a vehicle to a first beam and a second beam of an energy-absorbing guardrail end terminal during a side impact with the vehicle comprising:

attaching a spacer channel between the first beam and the second beam;

forming a force transfer member;

attaching the force transfer member to the spacer channel with a portion of the force transfer member positioned above ground level to receive a floor structure of the vehicle during the side impact;

forming a first support member and a second support member;

coupling the first and second support members at a first end to the spacer channel;

attaching a reactor plate to a portion of the first support member and the second support member proximate to a second end of the first support member and the second support member;

forming a first member having a first and second end and a first and second lateral edge;

coupling the first end of first member to the spacer channel and the torsion bar;

forming a second member having a first and second end and a first and second lateral edge;

coupling the first end of the first member to the spacer channel and torsion bar; and coupling a reactor plate on the first lateral edge of the first member and the first lateral edge of second member.

13. A method of manufacturing a system for transferring forces from a floor structure of a vehicle to a first beam and a second beam of an energy-absorbing guardrail end terminal during a side impact with the vehicle comprising:

attaching a spacer channel between the first beam and the second beam;

forming a force transfer member;

attaching the force transfer member to the spacer channel with a portion of the force transfer member positioned above ground level to receive a floor structure of the vehicle during the side impact;

forming a first support member and a second support member;

coupling the first and second support members at a first end to the spacer channel;

attaching a reactor plate to a portion of the first support member and the second support member proximate to a second end of the first support member and the second support member;

forming a first plate member having a first and second end and a first and second lateral edge;

forming a second plate member having a first and second end and a first and second lateral edge;

forming a third plate member having a first and second end and a first and second lateral edge;

forming a fourth plate member having a first and second end and a first and second lateral edge;

attaching the first end of the first, second, third, and fourth plate members to the spacer channel;

attaching a first reactor plate member to the first lateral edge of the first and second plate members;

attaching a second reactor plate member to an intermediate plate surface of the second and third plate members; and attaching a third reactor plate member to the first lateral edge of the third and fourth plate members.

* * * * *